US005674407A

United States Patent [19]

Vickers

[11] Patent Number: 5,674,407

[45] Date of Patent: Oct. 7, 1997

[54] METHOD FOR SELECTIVE ETCHING OF FLAT PANEL DISPLAY ANODE PLATE CONDUCTORS

[75] Inventor: Kenneth G. Vickers, Whitesboro, Tex.

[73] Assignee: Texas Instruments Incorporated, Dallas, Tex.

[21] Appl. No.: 497,956

[22] Filed: Jul. 3, 1995

[51] Int. Cl.[6] ..... H01J 9/20

[52] U.S. Cl. ..... 216/25; 216/76; 216/108; 445/24; 445/52

[58] Field of Search ..... 216/25, 4, 5, 76, 216/108

[56] References Cited

U.S. PATENT DOCUMENTS

| | | | |
|---|---|---|---|
| 3,755,704 | 8/1973 | Spindt et al. | 313/309 |
| 4,940,916 | 7/1990 | Borel et al. | 313/306 |
| 5,194,780 | 3/1993 | Meyer | 315/169.3 |
| 5,225,820 | 7/1993 | Clerc | 340/752 |
| 5,342,477 | 8/1994 | Cathey | 156/643 |
| 5,520,563 | 5/1996 | Wallace et al. | 445/24 |
| 5,558,554 | 9/1996 | Finklea et al. | 445/52 |
| 5,577,943 | 11/1996 | Vickers et al. | 445/24 |

OTHER PUBLICATIONS

*IEEE Trans. Electr. Insul.*, Sudarshan, T.S., Cross, J.D., Srivastava, K.D., "Prebreakdown Processess Associated With Surface Flashover of Solid Insulators in Vacuum," pp. 200–208, Vool. E1–12, No. 3, Jun. 1977.

*IEEE Trans. Electri. Insul.*, Tourreil, C.H., Srivastava, K.D., "Mechanism of Surface Charging of High–Voltage Insulators in Vacuujm," pp. 17–21, vol. E1–8, No. 1, Mar. 1973.

*Primary Examiner*—R. Bruce Breneman
*Assistant Examiner*—Michael E. Adjodha
*Attorney, Agent, or Firm*—Richard L. Donaldson; Wade James Brady; Rose Alyssa Keagy

[57] ABSTRACT

A method of fabricating an anode plate 80 for use in a field emission device comprising the steps of providing a substantially transparent substrate 70, depositing a layer of a transparent, electrically conductive material 90 on a surface of the substrate, and then removing portions of said layer of conductive material to leave stripes of said conductive material $\mathbf{90}_R$, $\mathbf{90}_G$, $\mathbf{90}_B$. The stripes of conductive material have a first and second corner 84, 88 distal from the substrate 70. The first and second corners 84, 88 of the stripes of conductive material are rounded and luminescent material 74 is applied on the conductive stripes 90. The first and second corners 84, 88 are rounded by applying voltage to the stripes 90 and then etching the stripes to form the rounded corners 84, 88.

17 Claims, 4 Drawing Sheets

METHOD FOR SELECTIVE ETCHING OF FLAT PANEL DISPLAY ANODE PLATE CONDUCTORS

TECHNICAL FIELD OF THE INVENTION

The present invention relates generally to flat panel displays and, more particularly, a method for fabricating an anode plate where the anode stripes have rounded corners.

BACKGROUND OF THE INVENTION

The advent of portable computers has created intense demand for display devices which are lightweight, compact and power efficient. Since the space available for the display function of these devices precludes the use of a conventional cathode ray tube (CRT), there has been significant interest in efforts to provide satisfactory flat panel displays having comparable or even superior display characteristics, e.g., brightness, resolution, versatility in display, power consumption, etc. These efforts, while producing flat panel displays that are useful for some applications, have not produced a display that can compare to a conventional CRT.

Currently, liquid crystal displays are used almost universally for lap top and notebook computers. In comparison to a CRT, these displays provide poor contrast, only a limited range of viewing angles, and, in color versions, they consume power at rates which are incompatible with extended battery operation. In addition, color liquid crystal display screens tend to be far more costly than CRT's which have an equal screen size.

As a result of the drawbacks of liquid crystal display technology, field emission display technology has been receiving increasing attention by industry. Flat panel displays utilizing such technology employ a matrix-addressable array of pointed, thin-film, cold field emission cathodes in combination with an anode comprising a phosphor-luminescent screen. The phenomenon of field emission was discovered in the 1950's, and extensive research by many individuals, such as Charles A. Spindt of SRI International, has improved the technology to the extent that its prospects for use in the manufacture of inexpensive, low-power, high-resolution, high-contrast, full-color flat displays is promising.

Advances in field emission display technology are disclosed in U.S. Pat. No. 3,755,704, "Field Emission Cathode Structures and Devices Utilizing Such Structures," issued Aug. 28, 1973, to C. A. Spindt et al.; U.S. Pat. No. 4,940,916, "Electron Source with Micropoint Emissive Cathodes and Display Means by Cathodoluminescence Excited by Field Emission Using Said Source," issued Jul. 10, 1990 to Michel Borel et al.; U.S. Pat. No. 5,194,780, "Electron Source with Microtip Emissive Cathodes," issued Mar. 16, 1993 to Robert Meyer; and U.S. Pat. No. 5,225,820, "Microtip Trichromatic Fluorescent Screen," issued Jul. 6, 1993, to Jean-Frédéric Clerc. These patents are incorporated by reference into the present application.

The Clerc ('820) patent discloses a trichromatic field emission flat panel display having a first substrate on which are arranged a matrix of conductors. In one direction of the matrix, conductive columns comprising the cathode electrode support the microtips. In the other direction, above the column conductors, are perforated conductive rows comprising the grid electrode. The row and column conductors are separated by an insulating layer having apertures permitting the passage of the microtips, each intersection of a row and column corresponding to a pixel.

On a second substrate facing the first, the display has regularly spaced, parallel conductive stripes comprising the anode electrode. These stripes are alternately covered by a first material luminescing in the red, a second material luminescing in the green, and a third material luminescing in the blue, the conductive stripes covered by the same luminescent material being electrically interconnected.

The Clerc patent discloses a process for addressing a trichromatic field emission flat panel display. The process consists of successively raising each set of interconnected anode stripes periodically to a first potential which is sufficient to attract the electrons emitted by the microtips of the cathode conductors corresponding to the pixels which are to be illuminated or "switched on" in the color of the selected anode stripes. Those anode stripes which are not being selected are set to a potential such that the electrons emitted by the microtips are repelled or have an energy level below the threshold cathodoluminescence energy level of the luminescent materials covering those unselected anodes.

A shortcoming of field emission displays of the current technology is the low emission intensity of the low voltage phosphors typically used as the luminescent material on the display screen. The low emission intensity of the phosphor has several origins, one of which is the low acceleration voltage used to excite the free electrons toward the anode. Currently, this acceleration voltage is limited by the potential which can be placed between adjacent transparent stripe anode conductors underlaying the phosphor stripes, typically about 300–500 volts. It is known that significantly improved performance and image brightness would be provided by increasing the anode potential to about 1000 volts. However, as the acceleration voltage is increased, the leakage current between the conductive anode stripes increases, and it is possible that high voltage breakdown can occur.

When a high voltage breakdown occurs, there may be arcing through the vacuum space between the anode stripes. Arcing may also occur between anode stripes as current flows across the anode surface from the anode stripe which is at a high potential to an adjacent anode stripe which is at a low potential. During the high voltage breakdown, the user may see a dimming of the display image where the current is leaving the high potential anode stripe. In addition, the user may simultaneously see a color bleed as an anode stripe which was at low potential receives current, and as a result, the phosphors at that location luminesce.

Factors contributing to the breakdown voltage between adjacent anode stripes include anode stripe geometry, surface conditions, the applied electric field, and transport time. The anode stripe geometry affects the breakdown voltage level because any sharp edges located on the anode stripe create an enhanced electric field during display operation and therefore lowers the voltage level at which breakdown will occur. The surface condition of the anode plate between the anode stripes affects the breakdown voltage level because contaminants present on the surface may encourage the flow of electrons between the anode stripes. In addition, the material composition of the surface affects the breakdown voltage level due to the inherent properties of water absorption, outgasing, and charge properties. The applied electric field affects the breakdown voltage because the leakage current is directly proportional to the potential applied to the anode stripe. Also, the higher the potential on the anode stripe the higher the chances are for a voltage breakdown below operating voltage. Transport time is the time it takes for the electrons to travel along the surface between the anode stripes. Therefore, if the anode stripe is not charged for a time long enough for the current to flow between anode stripes a high voltage breakdown will not occur. The mechanisms which affect high voltage breakdown are discussed in more detail in IEEE Trans. Electr. Insul., Sudarshan, T. S., Cross, J. D., Srivastava, K. D., "Prebreakdown Processes Associated With Surface Flashover of Solid Insulators in Vacuum," pp. 200–208, Vol. E1–E12, No. 3, June 1977, and IEEE Trans. Electr. Insul., Tourreil, C. H., Srivastava, K. D., "Mechanism of Surface Charging of High-Voltage Insulators in Vacuum," pp.17–21, Vol. E1–8, No. 1, March 1973, both incorporated herein by reference.

Increasing the anode potential to increase luminance has many benefits. For example, increasing the luminance permits the display image to be clearly visible in environments of bright ambient light, such as outdoor sunlight. An increased display luminance also accommodates FED overhead projector applications. As described above, increasing the anode potential to realize these benefits increases the likelihood of a high voltage breakdown. Therefore, the anode stripes may need to be spaced farther apart in high voltage applications to protect the apparatus against the occurrence of a high voltage breakdown.

Unfortunately, spacing the anode stripe conductors further apart to accommodate the high luminance applications decreases the image resolution. Decreasing the image resolution makes the display image less defined and therefore, the product will be less desirable to the user. Furthermore, future applications will demand higher resolutions and therefore closer spacing of the anode stripes. For example, while the most common resolution used today is a VGA standard of 640 pixels by 480 pixels for a 10" diagonal display, some applications exist which require the SVGA standard of 800 pixels by 600 pixels, or even require the XGA standard of 1240 pixels by 1080 pixels for the same display size.

In view of the above, it is clear that there exists a need for an improvement in the anode plate of a field emission flat panel display device which facilitates an increased acceleration voltage to thereby provide higher luminance and greater display image resolution.

SUMMARY OF THE INVENTION

In accordance with the principles of the present invention, there is disclosed herein a method of fabricating an anode plate for use in a field emission device. The method comprises the steps of providing a substantially transparent substrate, depositing a layer of a transparent, electrically conductive material on a surface of the substrate, and then removing portions of said layer of conductive material to leave stripes of said conductive material. The stripes of conductive material have a first and second corner distal from the substrate. The first and second corners of the stripes of conductive material are rounded and luminescent material is applied on the conductive stripes. The first and second corners are rounded by applying voltage to the stripes and then etching the stripes to form the rounded corners. In a preferred embodiment the surface is coated with an electrically insulating material, selected areas of the insulating material are removed, and then a first, second, and third bus are electrically connected to a first, second, and third series of stripes.

Alternatively, in accordance with the principles of the present invention, there is disclosed herein a method of fabricating an anode plate for use in a field emission device comprising the steps of providing a transparent substrate, depositing a layer of a transparent, electrically conductive material on a surface of the substrate, and then removing portions of said layer of conductive material to leave stripes of the conductive material. The stripes of conductive material have first and second corners distal from the substrate. The surface is coated with an electrically insulating material, and the insulating material is removed from selected areas of the surface. A first, second, and third bus is provided which are electrically connected to a first, second and third series of the conductive stripes. The first and second corners of the stripes of conductive material are rounded and luminescent material is applied on the conductive stripes. The first and second corners are rounded by applying voltage to the stripes and then etching the stripes to form the rounded corners.

The methods disclosed herein for manufacturing a field emission flat panel display device having anode stripes with rounded corners overcome limitations and disadvantages of the prior an display devices and methods. First, rounding the corners of the anode stripes enhances the electrical isolation between the adjacent conductors by decreasing the surface charge at the corners. In addition, the improved electrical isolation between adjacent stripe conductors allows higher anode potentials to be used during anode operation without the risk of panel failure from high voltage breakdown.

Furthermore, the use of Double Level Metal (DLM) technology improves the anode plate reliability by eliminating the mechanically attached external bus strip. The DLM structure also facilitates alternative methods for rounding the corners of the anode stripes during the manufacturing process. The result of the teachings of the present invention is that the FED can operate reliability at an increased anode voltage level and therefore operate successfully at an increased luminance.

Finally, it is noted that the improved breakdown qualities of the anode plate of the present invention will allow the use of narrower spacings between high potential stripe conductors of the anode, thereby allowing increased image resolution. Hence, for flat panel display device applications, the approaches in accordance with the present invention provide significant advantages.

BRIEF DESCRIPTION OF THE DRAWING

The foregoing features of the present invention may be more fully understood from the following detailed description, read in conjunction with the accompanying drawings, wherein.

DESCRIPTION OF THE PREFERRED EMBODIMENT

Figure 1:
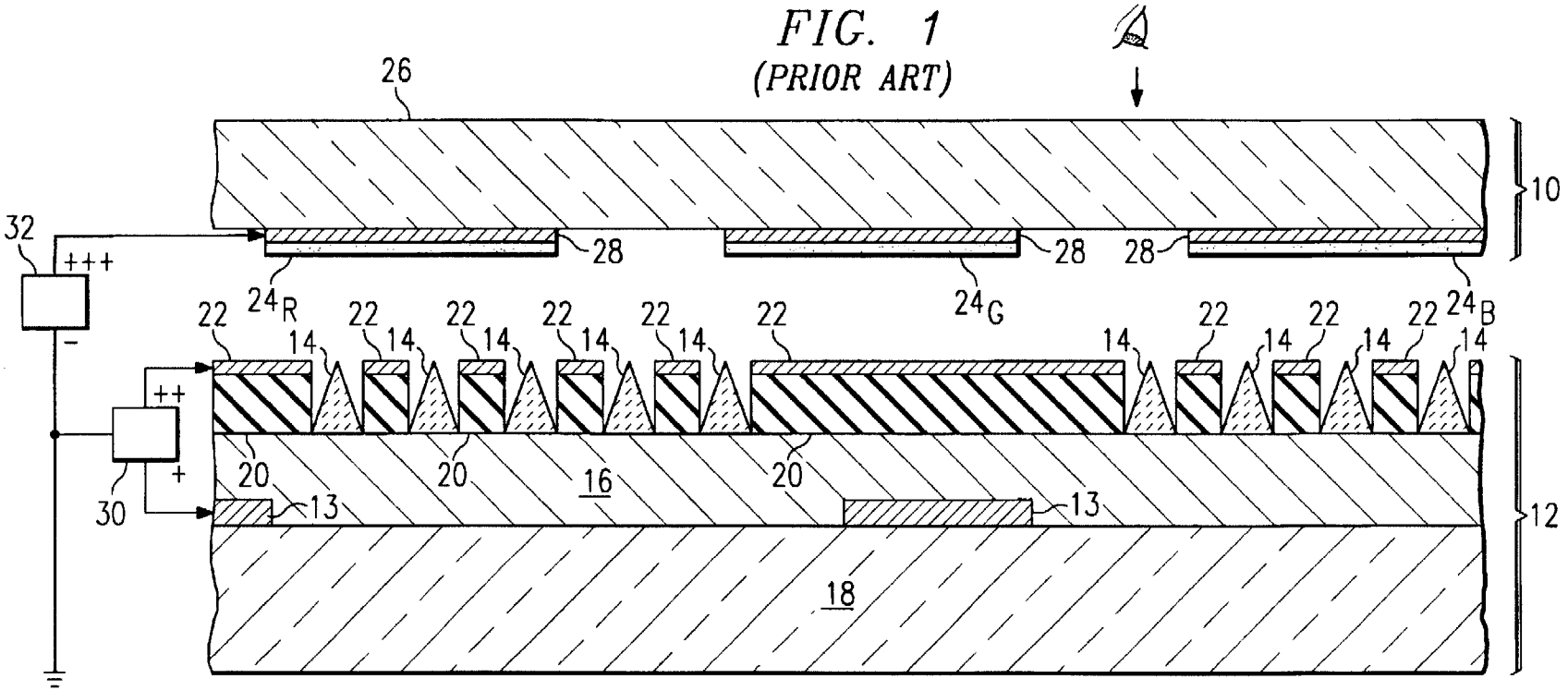
FIG. 1 (PRIOR ART)
FIG. 1 illustrates in cross section a portion of a field emission flat panel display device according to the prior art.

Referring initially to FIG. 1, there is shown, in cross-sectional view, a portion of an illustrative, prior art field emission flat panel display device. In this embodiment, the field emission device comprises an anode plate having an electroluminescent phosphor coating facing an emitter plate, the phosphor coating being observed from the side opposite to its excitation.

More specifically, the illustrative field emission device of FIG. 1 comprises a cathodoluminescent anode plate 10 and an electron emitter (or cathode) plate 12. (No true scaling information is intended to be conveyed by the relative sizes and positioning of the elements of anode plate 10 and the elements of emitter plate 12 as depicted in FIG. 1 .) The cathode portion of emitter plate 12 includes conductors 13 formed on an insulating substrate 18, a resistive layer 16 also formed on substrate 18 and overlaying conductors 13, and a multiplicity of electrically conductive microtips 14 formed on resistive layer 16. In this example, conductors 13 comprise a mesh structure, and microtip emitters 14 are configured as a matrix within the mesh spacings.

A gate electrode comprises a layer of an electrically conductive material 22 which is deposited on an insulating layer 20 which overlays resistive layer 16. Microtip emitters 14 are in the shape of cones which are formed within apertures through conductive layer 22 and insulating layer 20. The thicknesses of gate electrode layer 22 and insulating layer 20 are chosen in conjunction with the size of the apertures therethrough so that the apex of each microtip 14 is substantially level with the electrically conductive gate electrode layer 22. Conductive layer 22 is arranged as rows of conductive bands across the surface of substrate 18, and the mesh structure of conductors 13 is arranged as columns of conductive bands across the surface of substrate 18, thereby permitting selection of microtips 14 at the intersection of a row and column corresponding to a pixel.

Anode plate 10 comprises regions of a transparent, electrically conductive material 28, also referred to as anode stripes herein, deposited on a transparent planar support 26, which is positioned facing gate electrode 22 and parallel thereto, the conductive material 28 being deposited on the surface of support 26 directly facing gate electrode 22. In this example, the regions of conductive material 28, which comprise the anode electrode, are in the form of electrically isolated stripes comprising three series of parallel conductive bands across the surface of support 26, as taught in the Clerc ('820) patent. The transparent planar support 26 is illustratively glass, and conductive material 28 is illustratively Indium-Tin-Oxide (ITO). Anode plate 10 also comprises red, green, and blue cathodoluminescent phosphor coatings $24_R$, $24_G$, and $24_B$ respectively, deposited over conductive regions 28 so as to be directly facing and immediately adjacent gate electrode 22.

One or more microtip emitters 14 of the above-described structure are energized by applying a negative potential to conductors 13, functioning as the cathode electrode, relative to the gate electrode 22, via voltage supply 30, thereby inducing an electric field which draws electrons from the apexes of microtips 14. The potential between cathode electrode 13 and gate electrode 22 is approximately 70–100 volts. The emitted electrons are accelerated toward the anode plate 10 which is positively biased by the application of a substantially larger positive voltage from voltage supply 32 coupled between the gate electrode 22 and conductive regions 28 functioning as the anode stripe electrode. The potential between cathode electrode 13 and anode electrode 28 is approximately 300–800 volts. At any given time, voltage is applied to one anode stripe electrode 28 and not to the two adjacent anode strip electrodes 28 on either side of the charged conductive region 28. Energy from the electrons attracted to the anode conductors 28 is transferred to the phosphor coating 24, resulting in luminescence. During operation, the FED display selects color by applying the required voltage to the proper anode stripe electrodes 28 in order to attract electrons emitted from the cathode structure to red, green, or blue phosphor coatings $24_R$, $24_G$, and $24_B$. The electron charge is transferred from the phosphor coating 24 to the conductive regions 28, completing the electrical circuit to voltage supply 32. The image created by the phosphor stripes 24 is observed from the anode side which is opposite to the phosphor excitation, as indicated in FIG. 1.

It is to be noted and understood that true scaling information is not intended to be conveyed by the relative sizes and positioning of the elements of anode plate 10 and the elements of emitter plate 12 as depicted in FIG. 1. For example, in a typical FED shown in FIG. 1 there are approximately one hundred arrays of microtips 14 per display pixel; and there are three color stripes $24_R$, $24_B$, $24_G$ per display pixel.

Figure 2:
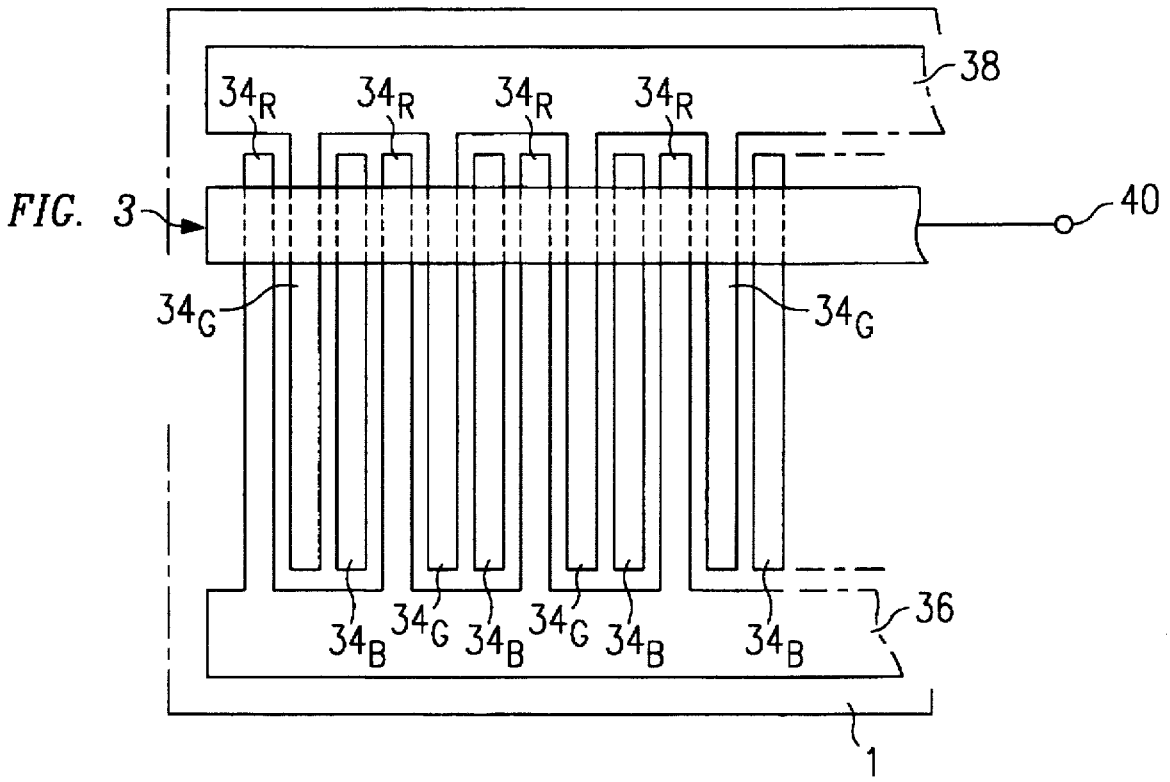
FIG. 2 (PRIOR ART)
FIG. 2 is a top view of the arrangement of conductive bands according to the prior art.
Figure 3:
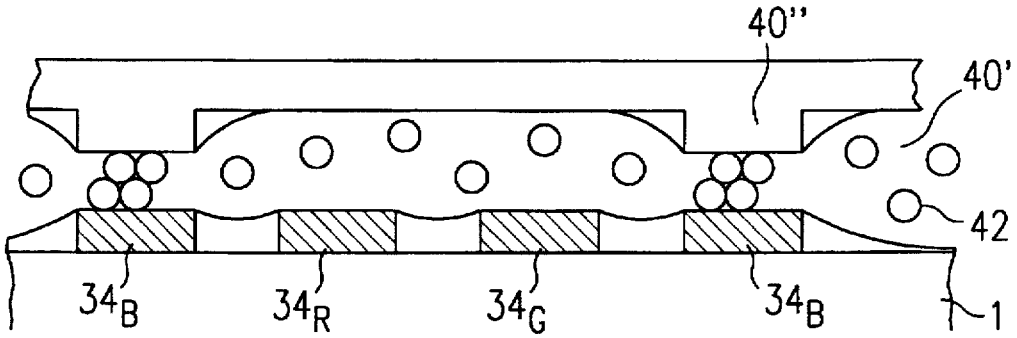
FIG. 3 (PRIOR ART)
FIG. 3 is a cross-sectional view of a conductive band of FIG. 2 according to the prior art.

The process of producing each frame of a display using a typical trichromatic field emission display includes (1) applying an accelerating potential to the red anode stripes while sequentially addressing the gate electrodes (row lines) with the corresponding red video data for that frame applied to the cathode electrodes (column lines); (2) switching the accelerating potential to the green anode stripes while sequentially addressing the rows lines for a second time with the corresponding green video data for that frame applied to the column lines; and (3) switching the accelerating potential to the blue anode stripes while sequentially addressing the row lines for a third time with the corresponding blue video data for that frame applied to the column lines. This process is repeated for each display frame. All red stripes $24_R$ of the anode plate 10 are electrically coupled together. All green stripes $24_G$ and all blue stripes $24_B$ are also electrically coupled to each other. The prior art structure used to facilitate the electrical interconnection of the color anode stripes $24_R$, $24_G$, and $24_B$, is shown in FIGS. 2 and 3. FIG. 2 shows the manner in which the conductive film 34 of the anode stripes are interconnected in the prior art. The conductive films 34 are substantially similar to the conductive films 24 of FIG. 1. In addition, anode plate 1 is substantially similar to the anode plate 10 of FIG. 1. Conductive film $34_R$ is covered with a phosphor coating luminescing in red, conductive film $34_B$ is covered with a phosphor coating luminescing in blue, and conductive film $34_G$ is covered with a phosphor coating luminescing in green.

The conductive films $34_R$ are electrically interconnected by a first conductive band 36. The conductive films $34_G$ are electrically interconnected by a second conductive band 38. The conductive films $34_B$ are electrically interconnected by a anisotropic conductive ribbon 40 described more fully below. The first and second conductive bands 36, 38 are formed on the anode plate 1 at the same time the conductive films 34 are formed. The conductive bands 36, 38 and the conductive films 34 are also coplanar and comprised of the same conductive material, illustratively indium-tin-oxide (ITO).

The conductive films $34_R$ which are connected to band 36 are interdigitated with the conductive films $34_G$ which are connected to band 38 and the conductive films $34_B$ which are connected to band 40. The anisotropic conductive ribbon 40 is deposited perpendicular to the conductive films 34.

FIG. 3 shows a section of the anode plate 1 along the anisotropic conductive ribbon 40, as indicated in FIG. 2. The anisotropic ribbon 40 is essentially formed by a conductive strip 40" and a film 40% The film 40' comprises carbide balls 42 distributed in an insulating binder forming the film 40', so as not to conduct electricity. As can be seen from FIG. 3, the conductive strip 40" crushes the film 40" at the conductive films $34_B$. The density of the balls 42 is such that at the crushed points the balls 42 are in contact and the ribbon 40 becomes conductive at these points. Thus, the conductive films $34_B$ are electrically connected to the conductive ribbon 40", but the non-crushed locations of film 40' are insulating.

There are numerous disadvantages to the prior art structure used to interconnect the red, green, and blue anode stripes. First, the use of the externally attached anisotropic ribbon 40 to connect the conductive films $34_B$ creates a significant FED system reliability problem. If the ribbon 40 isn't assembled to anode plate 1 properly then the conductive films 34 of two or three colors will be shorted together. Furthermore, the ribbon 40 can become disconnected from the conductive films $34_B$, causing lines to appear in the display image at the places where the conductive films $34_B$ are not electrically interconnected to the ribbon 40.

Figure 4:
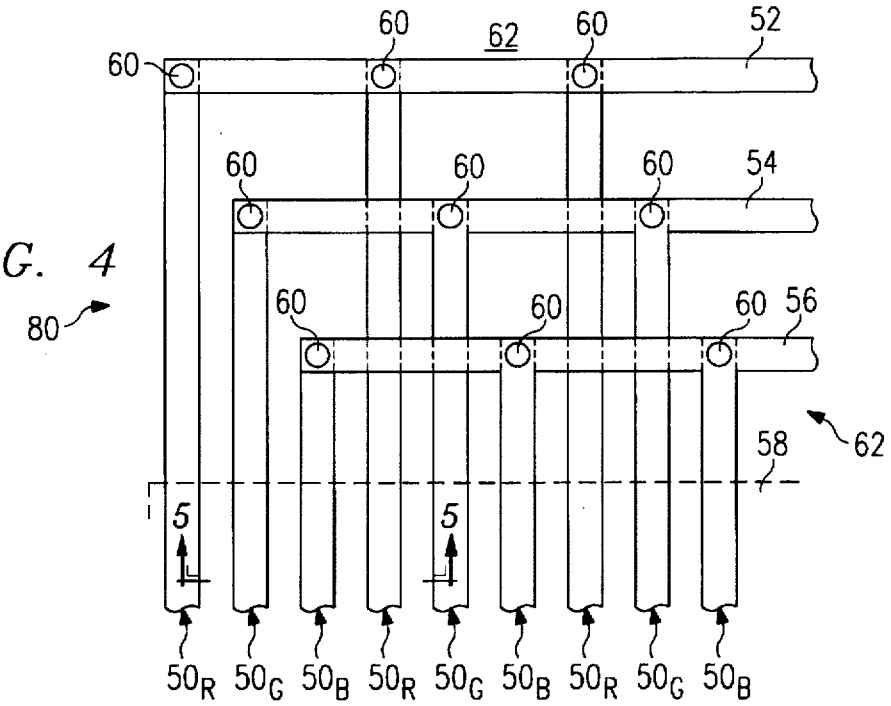
FIG. 4 is a top view of an arrangement of the conductive stripes and buses of the anode plate using double level metal techniques in accordance with the present invention.

One technique for improving the reliability of the anode plate is to eliminate the use of the externally attached ribbon. This may be accomplished by designing the anode plate using Double Level Metal (DLM) techniques. FIG. 4 is a top view of an arrangement of the conductive stripes and buses of the anode plate using double level metal techniques. As shown in FIG. 4, all red anode stripes $50_R$ are electrically interconnected to the red color bus 52, all green anode stripes $50_G$ are electrically interconnected to the green color bus 54, and all blue anode stripes $50_B$ are electrically interconnected to the blue color bus 56.

The anode plate of the present invention is designed such that the conductors 50 do not extend beyond their respective buses. The purpose of this design is to minimize the number of regions in the anode plate DLM bus structure where a bus of one color must cross an anode stripe of another color. For example, red bus 52 does not cross any green or blue anode stripes $50_G$, $50_B$, and green bus 54 only crosses the red anode stripes $50_R$.

In the structure shown in FIG. 4 anode stripes 50 may be illustratively 70 microns wide and spaced from one another by 30 microns. Since this application uses 70 micron wide anode stripes, a layout engineer would typically make the width of the buses 52, 54, 56 approximately 70 microns wide also. This bus width would be chosen because it would be easy to design and because it easily accommodates the current and voltage drop requirements of the anode plate design. Furthermore, a bus width of 70 microns would be selected because the layout engineer would not want to make the bus width smaller than the anode stripe width and thereby unnecessarily restrict the diameter of the via 60. The buses 52, 54, and 56 are illustratively spaced 70 microns from one another. Of course, other bus widths and bus spacings may be utilized according to design needs.

The region in which the charged electrons from the cathode plate travel to the anode stripes, thereby energizing the color phosphors and creating the color display image, is called the active, or image-forming, region 58. The buses 52, 54, and 56, as well as the interconnections between the buses and the anode stripes 50 are located in the bus region 62 outside the active region 58.

The anode stripes 50 are interconnected to the buses 52, 54, and 56 through vias 60 using the DLM structure shown in FIG. 4. The vias 60 illustratively have a diameter of 50 microns. Because every red, green, and blue anode stripe $50_R$, $50_G$, $50_B$ is connected to its respective red, green and blue bus 52, 54, 56, FIG. 4 illustrates only a representative portion of the total anode plate structure.

Figure 5:
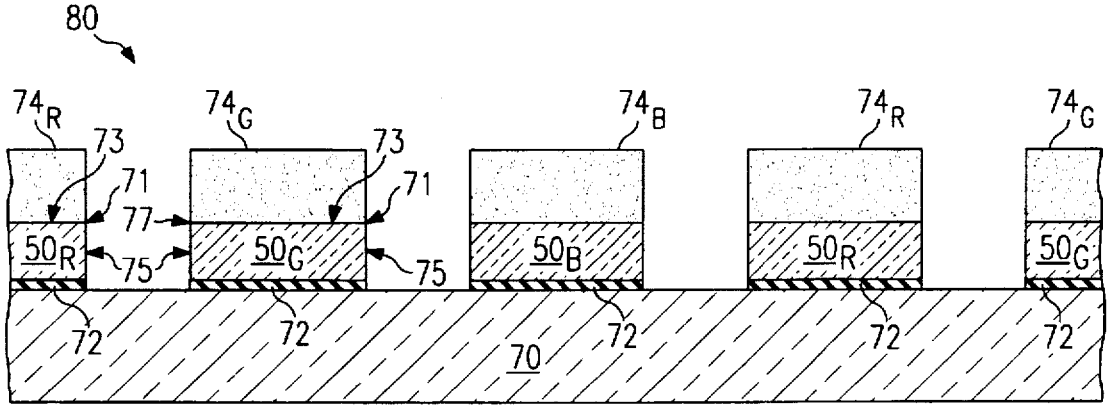
FIG. 5 (PRIOR ART)
FIG. 5 is a cross-sectional view of an anode stripe region of the anode plate according to the prior art.

Referring now to FIG. 5, there is shown a typical prior art cross-sectional view across multiple anode stripes in the active region 58 of anode plate 80, as indicated in FIG. 4. Anode plate 80, shown inverted from the position of the anode plate 10 of FIG. 1, comprises a transparent planar substrate 70 having a layer 72 of an insulating material, illustratively silicon dioxide ($SiO_2$). A plurality of electrically conductive anode stripes 50 are located above insulating layer 72. The conductive regions $50_R$, $50_G$, $50_B$, which are referred to collectively as conductors 50, comprise the anode electrode of the field emission flat panel display device. Luminescent material $74_R$ $74_G$ and $74_B$, referred to collectively as luminescent material 74, overlays conductors 50, thereby forming substantially parallel spaced-apart phosphor stripes.

In the present example, transparent substrate 70 comprises glass. Also in this example, conductive regions 50 comprise a plurality of parallel anode stripe conductors which extend normal to the plane of the drawing sheet. A suitable material for use as anode stripe conductors 50 may be indium-tin-oxide (ITO), which is optically transparent and electrically conductive. In this example, luminescent material 74 comprises a particulate phosphor coating which luminesces in one of the three primary colors, red $74_R$, green $74_G$, or blue $74_B$. A preferred process for applying phosphor coatings 74 to stripe conductors 50 comprises electrophoretic deposition. For purposes of this disclosure, as well as in the claims which follow, the term "transparent" shall refer to a high degree of optical transmissivity in the visible range (the region of the electromagnetic spectrum approximately between 4,000–8,000 Å).

No true scaling information is intended to be conveyed by the relative sizes of the elements of FIG. 5. By way of illustration, stripe conductors 50 may be 70 microns in width, and spaced from one another by 30 microns. The thickness of conductors 50 may be approximately 0.15 microns, and the thickness of phosphor coatings 88 may be approximately 5–10 microns. Substrate 70 is typically 1.1 mm thick.

Arching in the vacuum space between adjacent anode stripes 50 will first occur from the sharp-angled corner 71 of a first anode stripe 50 and the sharp-angled corner 77 of an adjacent second anode stripe 50. Arching through the vacuum will first occur between points 71 and 77 because the surface charge density of anode stripes 50 is much greater at the sharp-angled corner 71 than at the side surface 75 or top surface 73.

Figure 6:
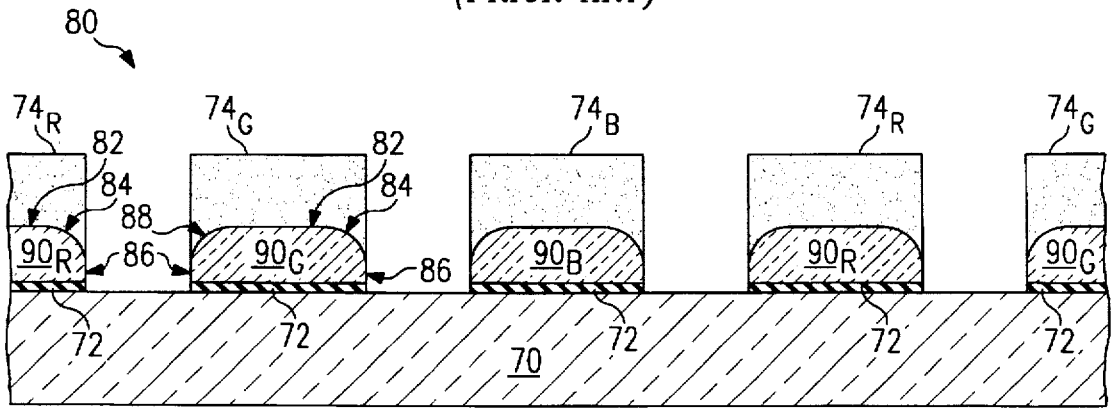
FIG. 6 is a cross-sectional view of an anode stripe region of the anode plate in accordance with the present invention.

In the present invention, the breakdown voltage between adjacent anode stripes 50 is improved by rounding the corners of the stripes 50; thereby normalizing the surface charge density across the anode stripes 50. This advantageous anode stripe structure is shown in FIG. 6. The elements in FIG. 6 which are similar in structure and which perform identical functions to those already described in relation to FIG. 5 are given the same numerical designators of their counterparts.

An improved voltage breakdown exists between the advantageously shaped anode stripes 90 in FIG. 6 because of the rounded corners 84, 88 which are distal from the substrate 70. The voltage breakdown is improved because the rounded corners 84, 88 facilitate a more evenly distributed surface charge density across the anode stripes 90. The rounded corners are created during the manufacturing process as discussed fully below.

Figure 7:
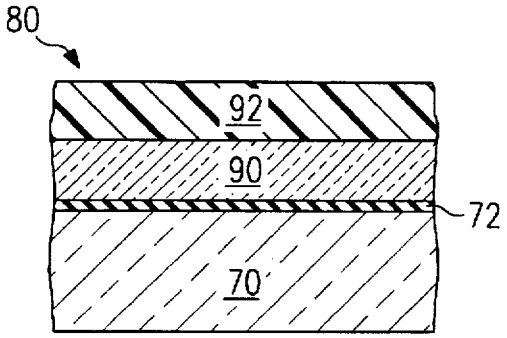
FIGS. 7 through 11 illustrate steps in a process for fabricating the anode plate of FIG. 6 in accordance with the present invention.
Figure 8:
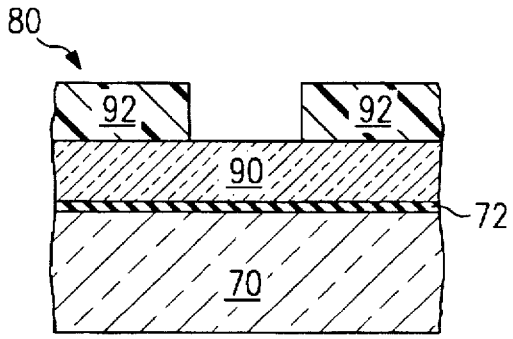
Figure 9:
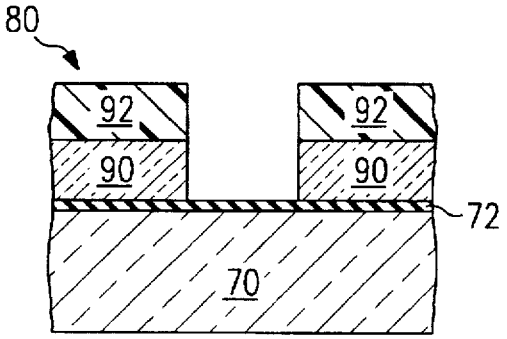

A typical method for manufacturing the anode plate 80 using the DLM process is as follows. Referring initially to FIG. 7, the glass substrate 70 is purchased with an $SiO_2$ insulating layer 72 which is 500 Å thick and a layer of ITO 90 which is 1,500 Å thick. A layer of photoresist 92, illustratively type AZ-1350J sold by Hoescht-Celanese of Somerville, N.J., is spun on over the ITO layer 90 to a thickness of approximately 10,000 Å. Next, a patterned mask (not shown) is disposed over the light-sensitive photoresist layer. The mask exposes desired regions of the photoresist to light. The mask used in this step defines anode stripes 90 which have a width of approximately 70 microns. The exposed regions are removed during the developing step, which may consist of soaking the assembly in a caustic or basic chemical such as Hoescht-Celanese AZ developer. The developer removes the unwanted photoresist regions Which were exposed to light, as shown in FIG. 8. The exposed regions of the ITO layer are then removed, typically by a reactive ion etch (RIE) process using carbon tetrafluoride ($CF_4$), leaving the structure shown in FIG. 9. Alternatively, the exposed regions of the ITO layer may be removed by a wet etch process using hydrochloric acid (HCI) and ferric chloride ($FeCl_3$). It may also be desirable at this point in the manufacturing process to remove the $SiO_2$ layer 72 underlying the etched-away regions of the ITO layer 90.

Figure 10:
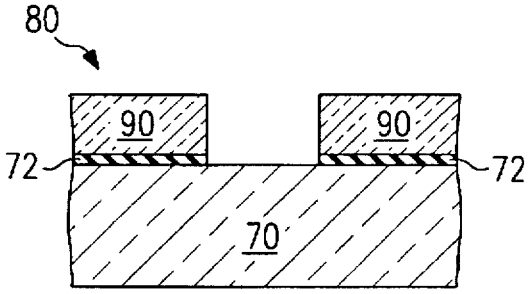

The remaining photoresist layer is removed by a wet strip process using commercial organic strippers or plasma ashing, leaving the structure shown in FIG. 10. The portions of ITO which now remain on substrate 70 are anode stripes 90.

The next step in the manufacturing process of anode plate 80 is to round the corners of the anode stripes 90. However, it is within the scope of the present invention to perform the step of rounding the anode stripe corners at other points in the manufacturing process.

A mechanical shorting clamp, which is well known in the processing art, is attached to the anode plate 80 such that all anode stripes 90 are shorted together and also coupled to a power supply. A low voltage is now applied to all of the anode stripes 90. The voltage applied to anode stripes 90 is illustratively under 10 volts. While the charge is applied to the anode stripes 90 of anode plate 80, the anode plate is dipped in a bath of hydrochloric acid (HCI) and ferric chloride ($FeCl_3$) which is illustratively one tenth the concentration of the solution discussed above to remove the exposed portions of the ITC stripe 90. Alternatively, the charged anode plate 80 could be exposed to a reduced concentration plasma etch using carbon tetraflouride ($CF_4$). It is desirable to use a reduced concentration plasma or wet etch because the etch rate will be slower than the etch rate used to etch the ITC stripes above and therefore the etch is more controllable.

Figure 11:
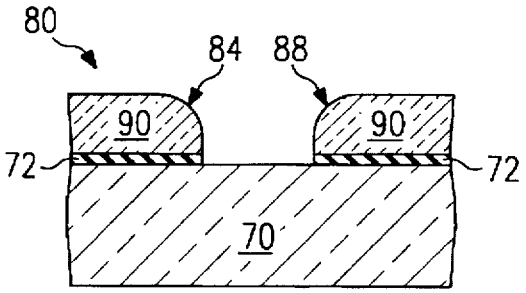

By applying the low voltage to the anode stripes 90 during the low concentration etch, the etchant ions will be attracted to the anode stripe corners where the field strength is greatest. During this etch process the sharp corners will start to round as the etchant ions remove the ITC molecules at the corners at a faster rate then at the top or side of the anode stripe. As the corners are rounded by the removal of the ITC material, the field strength at those corners will decrease until the field strength at the corners of anode stripes 90 is approximately equal to the field strength at the top and sides of the anode stripe. When the field strength at the top 82, corners 84, and sides 86 of the anode stripe 90 becomes normalized, the etch rate will be approximately equal at all of those areas. The anode plate 80 structure at this point in the manufacturing process is shown in FIG. 11. Illustratively, the etch of the charged anode plate continues until corners 84 and 88 have a 0.5 micron radius.

The next step in the fabrication process of the anode structure is to add an insulator layer, form the buses, and deposit the phosphor coating 84. These final steps are summarized below but described in more detail in co-assigned and co-pending U.S. patent application Ser. No. 08/402,596 "Reduction of the Probability of Interlevel Oxide Failures By Minimization of Lead Overlap Area Through Bus Width Reduction," assigned to Texas Instruments, Docket No. 20384, filed Mar. 13, 1995, and incorporated herein by reference.

An insulating layer (not shown) of Plasma Enhanced Chemical Vapor Deposition oxide (PECVD) is now applied over the entire anode plate 80 to a thickness of 15,000 Å. Alternatively, the insulator layer could be amorphous silicon dioxide or other types of insulating films which are deposited by a chemical vapor deposition (CVD) process. This insulating layer is also called the interlevel dielectric layer (ILD). A layer of photoresist is again applied and a mask defining the active region 58, and the 50 micron diameter vias 60 (both shown in FIG. 4) is added. Then the exposed photoresist is developed. The unwanted photoresist regions which are exposed to light are removed by soaking the assembly in a caustic or basic chemical, such as Hoescht-Celanese AZ developer.

Next, the anode plate is etched to remove the exposed regions of the ILD. The remaining photoresist layer is now removed by a wet strip process using commercial organic strippers or plasma ashing. The ILD is removed by either plasma etch (using $CF_4$ or other fluorocarbons), or by a wet etch process using HF.

The bus conductors 52, 54, and 56 (shown in FIG. 4) are formed by first depositing a second conductive layer of Al:2%Cu over the entire anode plate to a thickness of approximately 10,000 Å. A layer of photoresist is spun over the AlCu layer and a patterned mask defining buses 52, 54, 56 is then disposed over the light-sensitive photoresist layer. Next, the developing step removes the unwanted photoresist regions which were exposed to light. The exposed regions of the AlCu are then removed, typically using either plasma or wet chlorine chemistries, which do not harm the previously deposited metal ITO layer.

The AlCu bus layers 52, 54, and 56 are now electrically interconnected to anode stripes $\mathbf{90}_R$, $\mathbf{90}_G$, and $\mathbf{90}_B$ respectively in the via region 60 as a result of the DLM process described. The remaining photoresist layer is removed by a wet strip process using commercial organic strippers or plasma ashing. The completed DLM structure is shown in FIG. 4. The final step in the fabrication process of the anode structure is to provide the cathodoluminescent phosphor coatings 74, which are deposited over conductive ITO regions 90, typically by electrophoretic deposition. The final cross-sectional structure of the active region of the anode plate 80 is shown in FIG. 6.

Several other variations in the above processes, such as would be understood by one skilled in the art to which it pertains, are considered to be within the scope of the present invention. As a first such variation, it will be understood that a hard mask, such as aluminum or gold, may replace photoresist layer 92 of the above process. In addition, while the disclosure describes a manufacturing process using positive photoresist, a manufacturing process employing negative photoresist is also comprehended. Furthermore, while the disclosure describes forming the PECVD with one layer, the PECVD may be applied in two or more consecutive thin layers which together create a total thickness of 15,000 Å.

Finally, while the disclosure describes rounding the anode stripe corners before depositing the ILD using a mechanical shorting clamp to charge the anode stripes, the corners may be rounded at a different point on the manufacturing process. For example the anode stripe corners may be rounded after forming the buses 52, 54, and 56, and before depositing the phosphor coating 74. In this example, the buses 52, 54, and 56 are used, instead of the mechanical shorting clamp, to provide voltage to the anode stripes 90 during the anode stripe rounding step described above.

The methods disclosed herein for manufacturing a field emission flat panel display device having anode stripes with rounded corners overcome limitations and disadvantages of the prior art display devices and methods. First, rounding the corners of the anode stripes enhances the electrical isolation between the adjacent conductors by decreasing the surface charge at the corners. In addition, the improved electrical isolation between adjacent stripe conductors allows higher anode potentials to be used during anode operation without the risk of panel failure from high voltage breakdown.

Furthermore, the use of Double Level Metal (DLM) technology improves the anode plate reliability by eliminating the mechanically attached external bus strip. The DLM structure also facilitates alternative methods for rounding the corners of the anode stripes during the manufacturing process. The result of the teachings of the present invention is that the FED can operate reliability at an increased anode voltage level and therefore operate successfully at an increased luminance.

Finally, it is noted that the improved breakdown qualities of the anode plate of the present invention will allow the use of narrower spacings between high potential stripe conductors of the anode, thereby allowing increased image resolution. Hence, for flat panel display device applications, the approaches in accordance with the present invention provide significant advantages.

While the principles of the present invention have been demonstrated with particular regard to the structures and methods disclosed herein, it will be recognized that various departures may be undertaken in the practice of the invention. The scope of the invention is not intended to be limited to the particular structures and methods disclosed herein, but should instead be gauged by the breadth of the claims which follow.

What is claimed is:

1. A method of fabricating an anode plate for use in a field emission display device, said method comprising the steps of:

providing a transparent substrate;

depositing a layer of a transparent, highly resistive conductive material on a surface of said substrate;

removing portions of said layer of highly resistive conductive material to leave stripes of said highly resistive conductive material; said stripes of highly resistive conductive material having first and second corners distal from said substrate; and rounding said first and second corners of said stripes of highly resistive conductive material;

applying luminescent material on said highly resistive conductive stripes.

2. The method in accordance with claim 1 wherein said step of removing portions of said layer of conductive material comprises the sub-steps of:

coating said surface with a layer of photoresist;

masking said photoresist layer to expose regions corresponding to said stripes;

developing said exposed regions of said photoresist layer;

removing the developed regions of said photoresist layer to expose regions of said layer of conductive material;

removing said exposed regions of said layer of conductive material; and removing the remaining regions of said photoresist layer.

3. The method in accordance with claim 1 wherein said step of applying luminescent material on said conductive regions comprises electrophoretic deposition.

4. The method in accordance with claim 1 wherein said step of rounding said first and second corners of said stripes of conductive material comprises the sub-steps of:

applying voltage to said stripes; and etching said stripes to form said rounded first and second corners.

5. The method in accordance with claim 4 wherein said sub-step of etching said stripes comprises wet etching said conductive material.

6. The method in accordance with claim 5 wherein a solution of hydrochloric acid and ferric chloride is used as an etchant.

7. The method in accordance with claim 4 wherein said sub-step of etching said stripes comprises dry etching said conductive material.

8. The method in accordance with claim 7 wherein carbon tetrafluoride is used as an etchant.

9. The method in accordance with claim 1 further comprising, immediately following the rounding step, the steps of:

coating said surface with an electrically insulating material;

removing said insulating material from selected areas of said surface;

providing a first bus electrically connected to a first series of said conductive stripes;

providing a second bus electrically connected to a second series of said conductive stripes; and providing a third bus electrically connected to a third series of said conductive stripes.

10. A method of fabricating an anode plate for use in a field emission device, said method comprising the steps of:

providing a transparent substrate;

depositing a layer of a transparent, highly resistive conductive material on a surface of said substrate;

removing portions of said layer of highly resistive conductive material to leave stripes of said highly resistive conductive material; said stripes of highly resistive conductive material having first and second corners distal from said substrate;

coating said surface with an electrically insulating material;

removing said insulating material from selected areas of said surface;

providing a first bus electrically connected to a first series of said highly resistive conductive stripes;

providing a second bus electrically connected to a second series of said highly resistive conductive stripes;

providing a third bus electrically connected to a third series of said highly resistive conductive stripes;

rounding said first and second corners of said stripes of highly resistive conductive material;

applying luminescent material on said highly resistive conductive stripes.

11. The method in accordance with claim 10 wherein said step of removing portions of said layer of conductive material comprises the sub-steps of:

coating said surface with a layer of photoresist;

masking said photoresist layer to expose regions corresponding to said stripes;

developing said exposed regions of said photoresist layer;

removing the developed regions of said photoresist layer to expose regions of said layer of conductive material;

removing said exposed regions of said layer of conductive material; and removing the remaining regions of said photoresist layer.

12. The method in accordance with claim 10 wherein said step of applying luminescent material on said conductive regions comprises electrophoretic deposition.

13. The method in accordance with claim 10 wherein said step of rounding said first and second corners of said stripes of conductive material comprises the sub-steps of:

applying voltage to said stripes; and etching said stripes to form said rounded first and second corners.

14. The method in accordance with claim 13 wherein said sub-step of etching said stripes comprises wet etching said conductive material.

15. The method in accordance with claim 14 wherein a solution of hydrochloric acid and ferric chloride is used as an etchant.

16. The method in accordance with claim 13 wherein said sub-step of etching said stripes comprises dry etching said conductive material.

17. The method in accordance with claim 16 wherein carbon tetrafluoride is used as an etchant.

* * * * *